United States Patent [19]

Adams

[11] 4,327,853

[45] May 4, 1982

[54] FOLDABLE PACK BELT

[76] Inventor: Brian J. Adams, 17 Elliewood Ave., Charlottesville, Va. 22903

[21] Appl. No.: 224,485

[22] Filed: Jan. 12, 1981

Related U.S. Application Data

[63] Continuation-in-part of Ser. No. 38,945, May 14, 1979, Pat. No. 4,244,499.

[51] Int. Cl.[3] ..... B65D 30/10; B65D 33/24

[52] U.S. Cl. ..... 224/224; 224/222; 224/228; 150/7

[58] Field of Search ..... 224/224, 222, 219, 228, 224/229, 267, 195; 150/7

[56] References Cited

U.S. PATENT DOCUMENTS

| | | | |
|---|---|---|---|
| 926,402 | 6/1909 | Geissler | 224/222 |
| 1,184,311 | 5/1916 | Boch | 224/222 |
| 1,478,497 | 12/1923 | Welch | 224/224 |
| 2,298,600 | 10/1942 | Stember | 224/228 X |
| 2,383,748 | 8/1945 | Sherman | 224/228 X |
| 3,374,636 | 3/1968 | Mason | 224/224 X |
| 3,525,376 | 8/1970 | Muhlhauser | 150/52 |
| 3,543,977 | 12/1970 | Lockridge | 224/222 |
| 3,557,853 | 1/1971 | Jones | 150/7 |
| 3,963,199 | 6/1976 | Dravaz | 244/148 |
| 4,029,243 | 6/1977 | Zerobnick et al. | 244/8 R |
| 4,079,871 | 3/1978 | Sica | 244/5 D |
| 4,139,130 | 2/1979 | Glusker et al. | 244/54 W |
| 4,139,133 | 2/1979 | Repka | 244/26 C |
| 4,244,499 | 1/1981 | Adams | 224/224 |

*Primary Examiner*—Steven M. Pollard

*Attorney, Agent, or Firm*—Fleit & Jacobson

[57] ABSTRACT

A foldable pack belt for carrying at least one article. The pack belt is formed by folding longitudinally-extending edges of a planar member about an article or articles placed on an inner surface of a carrying portion of the planar member. A first set of complementary fastening devices are associated with the longitudinally-extending edges to releasably and adjustably hold the planar member in a rolled condition. Subsequently, transversely-extending edges of the planar member are folded towards each other and releasably and adjustably interconnected to each other by components of second complementary fastening devices to form the pack. The components of the first and second fastening devices are adjustable with respect to each other so that the size of the pack can be varied to accommodate variations in the size of the waist of a user and the size of articles to be carried. Also, the distance between the carrying portion of the planar member and the side edges is selectively adjustable so that the carrying volume is variable in accordance with the bulk of the carried article or articles.

16 Claims, 9 Drawing Figures

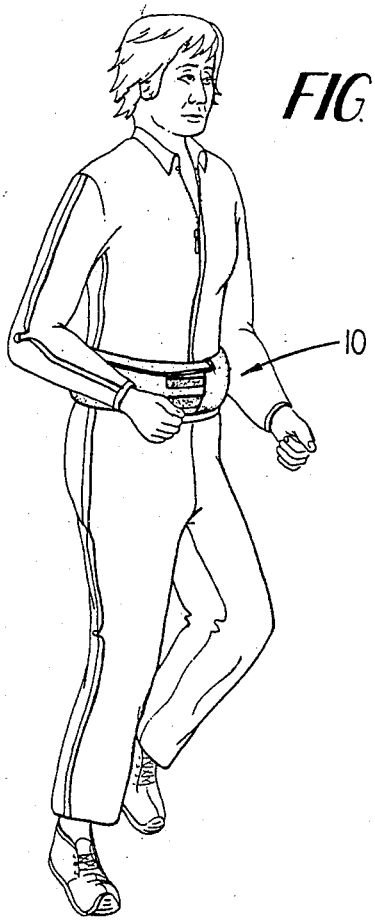
FIG. 1
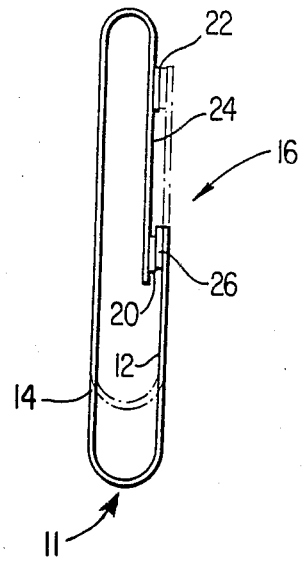
FIG. 5
FIG. 2
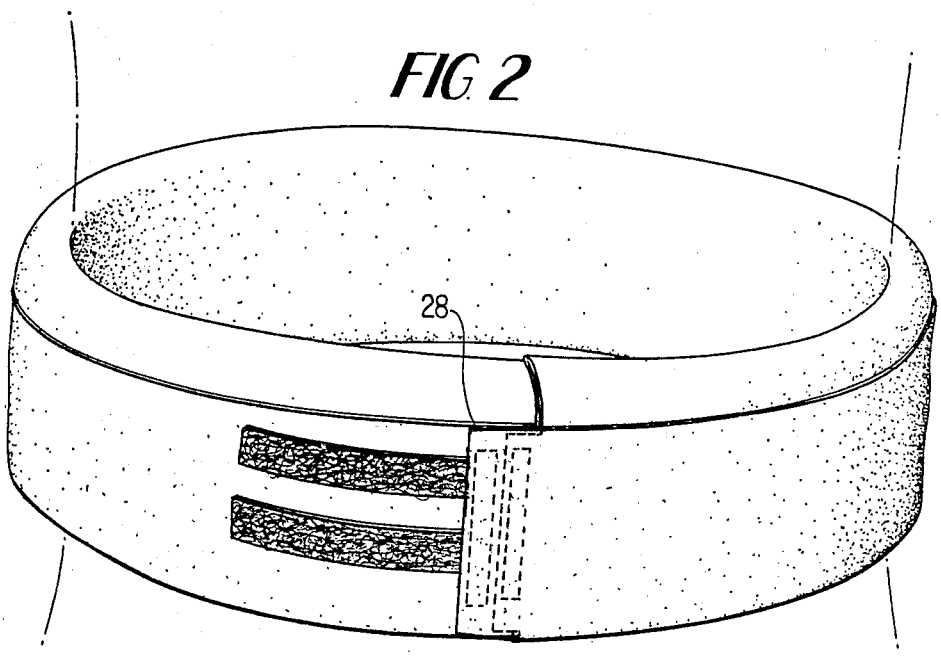

FOLDABLE PACK BELT

CROSS-REFERENCE TO RELATED APPLICATION

This is a continuation-in-part of U.S. patent application Ser. No. 38,945, filed May 14, 1979 now U.S. Pat. No. 4,244,499.

BACKGROUND OF THE INVENTION

1. Field of the Invention

This invention relates to a foldable container or backpack for carrying equipment and supplies. More particularly, this invention relates to a belt-supported pack of unitary construction that is primarily worn around a person's waist for carrying equipment and supplies, such as supplies used for jogging, hiking, climbing, and other related outdoor activities.

2. Description of the Prior Art

Known in the prior art are complementary fastening mechanisms that use synthetic materials having complementary surfaces which adhere to each other when pressed together and resist separation when a force is applied parallel to their adhering surfaces. A first of the complementary surfaces has a multiplicity of small filamentary members of a crinkle configuration forming "snags" which cooperate with each other to define a mat surface. A second of the complementary or mating surfaces has a multiplicity of small loops made up of filamentary material forming "hooks " engageable with the "snags" of the first surface. Hereinafter, the term "snag surface" or "snag" will be used to refer to the first surface and the term "hook surface" or "hook" will be used to refer to the second surface. Also, such fastening mechanism will be generally referred to as "snag and hook fasteners." One type of such snag and hook fastener is sold under the trademark VELCRO.

SUMMARY OF THE INVENTION

In accordance with the present invention, a backpack, belt pack or foldable container is provided that is adjustable about both horizontal and vertical axes to exert biaxial forces on an article or articles positioned within the container.

The container utilizes a substantially planar, usually and generally rectangular-shaped carrying member that is folded or rolled about its longitudinal or horizontal axis to exert a first axial force on articles positioned within the carrying member. A first complementary fastening mechanism is provided to hold the carrying member in its rolled condition. Subsequently, the rolled member is folded about the waist of a user to exert a second axial force on articles positioned within the carrying member. A second set of complementary fasteners are connected to the ends of the carrying member to releasably secure the member about the waist of the user. Provision of the two sets of complementary fasteners enables subjecting carried articles to both horizontal and vertical forces so that the articles are securely held within the container in desired positions.

In a preferred embodiment of the present invention, the complementary fasteners are snag and hook type fasteners that are positioned on predetermined portions of the carrying member to allow the rolling of the member about its horizontal axis and the folding of the rolled member about its vertical axis. Other fastening mechanisms like those referred to in the parent application are also suitable. The carrying member, in one embodiment, is formed of a porous material so that air is free to pass therethrough, thereby minimizing the discomfort of a wearer of the container. In another embodiment, at least a portion of the carrying member is covered with or made of a light reflecting material that enhances observation of a wearer. One type of such reflecting material is sold under the trademark EARLY WARNING.

Another characteristic of a presently preferred embodiment of the present invention is the formation of the carrying member from three interconnected elongate members. Central portions of the side members are formed with "pockets" positioned between confronting edges of the side members and the central member. The "pockets" are formed by folding on to the side members flaps protruding from their inner side edges. Fasteners are provided to releasably secure the material in its folded condition. When items of relatively small size are carried by the pack, the "pockets" are constricted to reduce the size of the carrying portion of the pack so that the articles can be subjected to sufficient tension to prevent their movement within the formed sack. On the other hand, when items of relatively large size are to be carried, the pocket fasteners are released to allow expansion of the folded portions to thereby increase the size of the carrying portion of the sack. The pockets are completely unfolded to provide the maximum carrying space, or are partially unfolded to provide a carrying pack of intermediate size.

In another form of the invention, portions of the pack that are positioned in the front of a user, are prestitched together so that the tubular enclosure of the pack is partially pre-formed. It will be appreciated that the limited adjustability of a partially pre-formed carrying member reduces somewhat the flexibility of the sack; however, pre-forming facilitates use of the sack.

The invention, and its objects and advantages, will become more apparent in the detailed description of the preferred embodiments.

BRIEF DESCRIPTION OF THE DRAWINGS

In the detailed description of the preferred embodiments presented below, reference is made to the accompanying drawings, in which:

FIG. 1 is an illustration of one embodiment of a container or belt of the present invention in use;

FIG. 2 is an enlarged perspective view of the embodiment illustrated in FIG. 1;

FIG. 5 is an end view of the embodiment illustrated in FIG. 3 in a partially assembled position;

DESCRIPTION OF THE PREFERRED EMBODIMENTS

Figure 3:
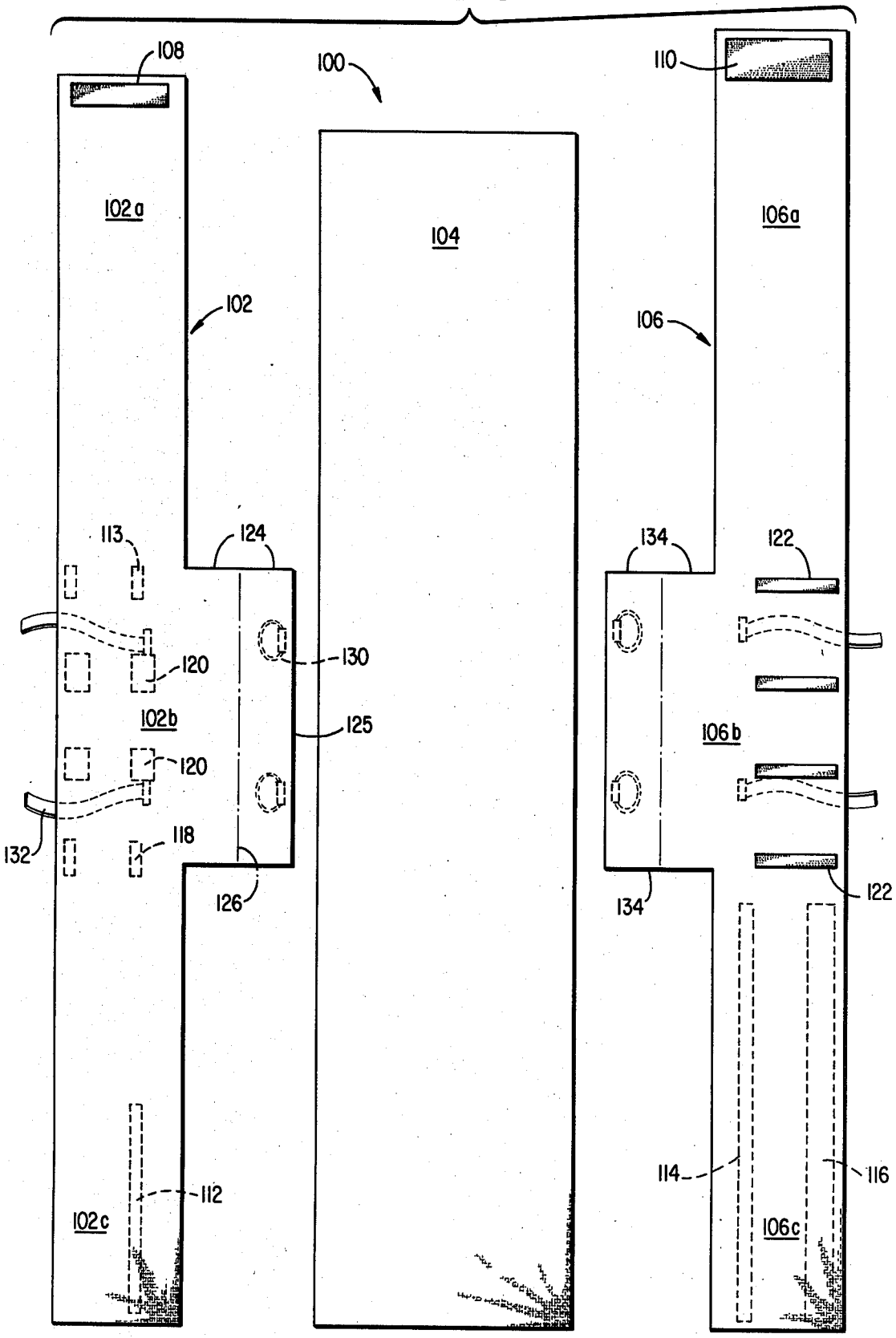
FIG. 3 is a schematic, disassembled view of another embodiment of the present invention.

Because backpacks and similar containers for articles are well known, the present description will be directed in particular to elements forming part of, or cooperating more directly with, the present invention. Elements not specifically shown or described herein are understood to be selectable from those known in the art.

Referring now to the drawings, and to FIGS. 1, 2, and 5 in particular, one embodiment of the present invention is illustrated and will be described in connection with a foldable container or pack belt, generally designated 10. This embodiment is described in detail in parent U.S. patent application Ser. No. 38,945, filed May 14, 1979, the contents of which are herein incorporated by reference. The pack belt 10, in an unassembled or unfolded condition, has a substantially planar, preferably usually and generally rectangular-shaped carrying member, generally designated 11. The carrying member 11 has an inner surface or side 12, and an outer surface or side 14. As illustrated in FIG. 5, a first complementary fastening mechanism, generally designated 16, has a snag surface positioned on the outer surface. The snag surface has first and second horizontally-extended surfaces or members 20 and 22, respectively. A plurality of hook surfaces or members 26 engageable with the first snag members are positioned along edge portions of inner surface 12. It will be appreciated that the configurations, lengths and widths of hook and snag surfaces, or members, are determined by the anticipated varitions in articles to be carried in the pack belt. If only one type of article is to be carried, one of the strips 20 and 22 could be eliminated. If a wide variation in the size of articles is expected, additional snag members can be positioned parallel to the illustrated members. Alternatively or in addition, the lengths of the members 26 can be increased.

As illustrated in FIG. 5, the first complementary fasteners provide for releasably securing a carrier member 11 rolled about its longitudinal or horizontal axis. In one embodiment, the ends of one of the components of the complementary fasteners are shaped so as to prevent separation of the components from each other, for instance the end can be appropriately enlarged. In another embodiment, the components are separable from each other. If the bulk of the article or articles to be carried is relatively small, hooks 26 are engaged with snags 22 to secure the carrying member in the chain dotted position illustrated in FIG. 5. If numerous or bulky articles are carried, hooks 26 are engaged with snags 20, as illustrated with solid lines in FIG. 5. For the purposes of clarity, the articles encompassed by the rolled carrying member have not been illustrated.

In order to hold the rolled carrying member 11 in a position folded about a vertical axis, a second set of complementary fasteners, generally designated 28, are connected to carrying member 11. The second complementary fasteners 28 have a plurality of first or snag surfaces or components. The snag members extend from one transverse edge of carrying member 11 towards the other. The length of the snag members is determined by anticipated variations in the waist of a user of pack belt 10 and variations in the bulk of materials or articles to be carried. The other transverse edge of carrying member 11 has a plurality of surfaces or hook members. When the pack belt is folded around the waist of a user, as illustrated in FIGS. 1, and 2, the hook members engage one or more of the snag members to releasably secure the pack belt around the waist of the user.

The fasteners employed to secure the carrying member around the waist are adjustable to compensate for variations in the size of a user's waist, as a minimum, and, at a maximum, variations in both the size of a user's waist and variations in the bulk of articles carried in the pack.

Considering now the use of the previously described pack belt of the present invention, the belt is described pack belt of the present invention, the belt is first unfolded and positioned with its inner surface facing upwards. Material, such as clothing and the like to be transported, is then positioned in a central portion of the carrying member 11. After the articles have been suitably positioned, the carrying member is folded about its horizontal axis or an axis slightly skewed from the horizontal by first positioning the portion of the member carrying snags 20 and 22 over the articles positioned on the carrying member. Subsequently, the portion of the carrying member containing the hooks 26 is folded about the horizontal axis and the hooks 26 are engaged with selected portions of snag components 20 or 22. The configuration of the articles to be carried determines whether or not the axes of hooks 20 are perpendicular or skewed to the axes of the snags. The rolled tube formed by the engagement between hooks 26 and snags 20 or 22 is then positioned about the waist of the user. The components of fastener 28 are then engaged with each other to releasably hold the folded and rolled carrying member about the waist of the user, as illustrated in FIGS. 1 and 2.

It will be readily appreciated that engagement between the snags 20 or 22 and hooks 26 subjects articles positioned inside the rolled carrying member 11 to an axial force in one direction. Similarly, engagement between snags and hooks of the fastener 28 subjects the articles to a second force that extends generally perpendicular to the first force. Since the carried articles are subjected to two different substantially perpendicular forces, they are securely held in the pack belt in desired positions. There is virtually no movement of the articles. Thus, there is little shifting of the articles that might discomfort a wearer of the pack belt.

With the previous embodiment, the complementary fasteners have been snag and hook fasteners. This is the preferred mode presently contemplated of practicing the invention.

Figure 4:
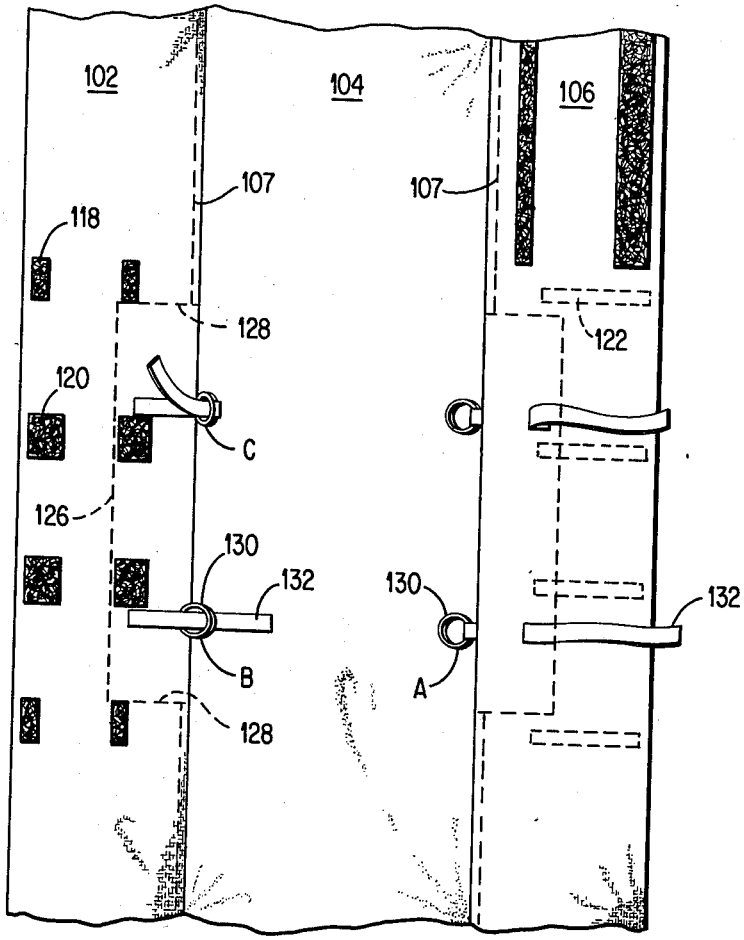
FIG. 4 is an assembled view of the embodiment of FIG. 3.
Figure 6:
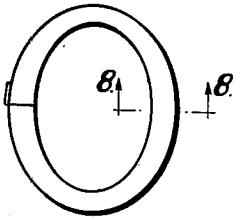
FIG. 6 is a schematic view of the embodiment of FIG. 3 in a first assembled condition.
Figure 7:
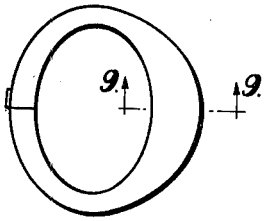
FIG. 7 is a schematic view of the embodiment of FIG. 3 in a second assembled condition.

Referring now to FIGS. 3, 4, and 6 to 9, an embodiment of the invention is illustrated in which the width of the carrying portion is adjustable. The embodiment of the foldable carrier, which is generally designated 100, is formed of three interconnected components 102, 104, 106. It will be appreciated that the carrier can be formed from one, two, or a plurality of components. Elongated side members 102 and 106 have inner side edges connected to confronting longitudinal edges of central member 104 by stitching, glueing, or other suitable means. For the purposes of illustration, stitching 107 is illustrated in FIG. 4 connecting confronting longitudinal edges of the members to each other.

Each of the side members has a first end section or region (102*a*, 106*a*), a central section or region (102*b*, 106*b*), and a second end section or region (102*c*, 106*c*). End regions of the first sections (102*a*, 106*a*) extend beyond the transverse or lateral edge of central member 104 and have hook members 108, 110, respectively, affixed thereto by any suitable means, such as stitching. The region 106*a* is longer than the region 102*a* so that the hook member 110 overlaps the hook member 108 when the carrier is folded around the horizontal axis. This prevents section 108 from obscuring or covering any part of section 110's adhering or fastening surface when the fasteners are engaged to secure the carrier around the vertical axis.

The snag surfaces 114 and 116, which are affixed to section 106*c*, are engageable with both hook members 108 and 110. If a large bulk is to be transported, then the whole carrier expands. This causes hook 110 to only partially overlap hook 108. Hook 108 will then engage snag 116 and snag 112, which had previously been covered by section 106*c*. This produces uniform support of the cargo around the vertical axis. It also provides stronger fastening since more fastener surfaces are employed to accommodate a larger and probably heavier cargo. Hook members 108 and 110 cooperate with selected portions of snag surfaces 114, 116 and 112 to form a second complementary fastener that operates in a manner similar to the previously discussed second complementary fastener 28.

Attached to the central section 102*b* are snag members or surfaces 118 and 120. The members 120, which are disposed inside of the members 118, are approximately twice as wide as the members 18 to provide enlarged and stronger holding surfaces. Hook surfaces 122 are positioned on the central section 106*b* of the other side member. The hook surfaces 122 cooperate with the snag members 118 and 120 to form first complementary fasteners similar to the previously described fastening means 16.

The central portions 102*b* and 106*b* have main body portions with lengths approximately equal to the width of a back of an intended user of the pack belt. An enlarged, generally rectangular, portion 124 protrudes from the main body portion of body member 102*b* beyond the inner longitudinal side edges of the sections 102*a* and 102*c*. The inner longitudinal edge 125 of the enlarged portion is connected to the center component 104, for instance, by stitching. As illustrated in FIG. 4, the protruding portion is folded back onto the main body along a line 126. Overlapping portions of the folded portion 124 are connected to each other by a row of stitching 128. Buckles 130 are connected to the protruding portion 124 and straps 132 insertable into the buckles are carried by the main body portion of region 102*b*. The buckles and straps cooperate with each other to form cooperating fastening means.

As illustrated in FIG. 3, member 106*b* has a protruding portion 134. Since the protruding portion is similar to the protruding portion 124, the same reference numerals have been used to identify the buckles 130 and straps 132 carried by the protruding portion 134.

Figure 8:
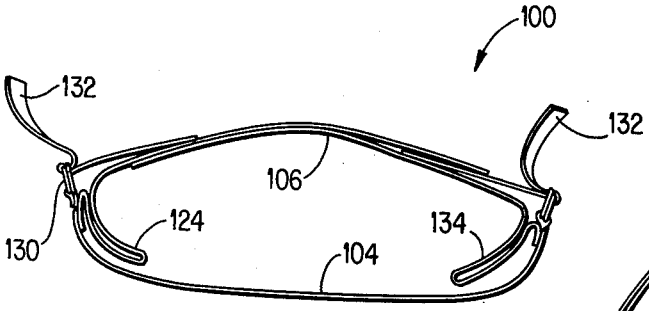
FIG. 8 is a schematic view along line 8—8 of FIG. 6.
Figure 9:
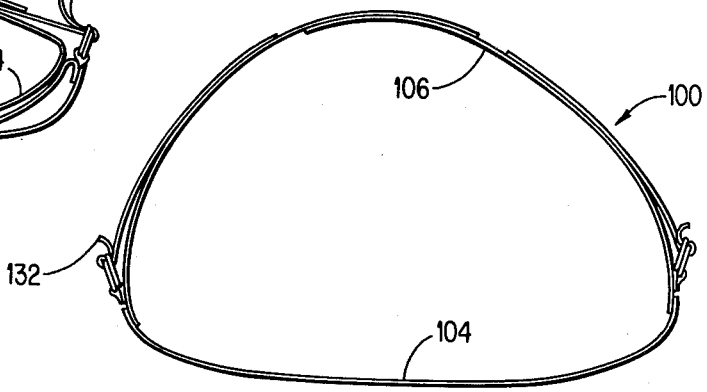
FIG. 9 is a schematic view along line 9—9 of FIG. 7.

As illustrated in FIGS. 8 and 9, the straps 132 cooperate with the buckles 130 to control the size of the pocket formed by the folding of the protruding portion 124. Fig. 8 illustrates use of the buckles 130 and belts 132 to reduce the size of the carrying volume of the carrier 100. In this position, relatively large pocket is formed by folding the protruding portion 124 back onto the main body portion of portion 102*b*. FIG. 9 illustrates an arrangement in which the pocket is virtually eliminated, and the carrier 100 has its largest carrying volume. For esthetic purposes when carrying maximum volume, it is preferable that the straps 132 be engaged with the buckles 130. Such engagement prevents undesirable uncontrolled movement of the buckles and belts during movement of the user.

As can be seen from FIG. 4, the strap 132 is spaced from the buckle 130 when the protruding portion is inwardly folded, as illustrated by the reference letter "A." The end of the strap is then fed through the buckle 130, as illustrated by the reference letter "B." The end portion of the strap is then fed back through one of the buckles, as illustrated by the reference letter "C," in order to fix the size of the pocket formed by the folded portion 124.

In use, the bulk of the materials to be carried is determined by the user. The portions of the straps 132 engaged by the buckles 130 are then adjusted to vary the distance between the outer lateral edges of the members 102 and 106 and the central member. The articles to be carried are then placed on the inside surface of the central member 104, and the side member 102 is folded over the article or articles. Side member 106 is then folded over side member 102, and portions of the snag surfaces 122 are engaged with selected ones of the hook members 118 and 120 to exert a first axial force on the carried articles. The carrier is then folded about the waist of the user, the hook members 108 and 110 are engaged with snag members 114 and 116, if the bulk is small. If the bulk is large, then hooks 110 engage with snags 114 and 116 and hooks 108 engage with snags 112 and 116. Such engagement provides enhanced holding strength because of the increased area of engagement and uniform support around the vertical axis. These. engagements exert a second axial force on the carried articles. By exerting two substantially perpendicular axial forces on the carried articles, there is relatively little, if any, shifting of the articles within the carrier during movement of the user.

In an embodiment of the present invention (not illustrated), the side flaps are folded over each other and pre-stitched to each other in regions close to the ends of the sack (portions that will be positioned on the front of a user). This embodiment may reduce the uniformity of support around the vertical axis for a large cargo. Fasteners similar to the fasteners 118, 120 and 122 are used to releasably secure portions of the side flaps overlying the carrying portion positioned on the user's back. This embodiment makes it relatively easy to open and close the pack after it has been removed from the user's waist. Since the ends are already interconnected, the ability to exert a second axial force on the carried article or articles is reduced.

While preferred embodiments of the present invention have been described, it should be readily apparent that various modifications are possible without varying from the spirit and scope of the present invention. For instance, snag and hook or any other types of fasteners could be used in place of the buckles 130 and straps 132. Also, the sections 102, 104 and 106 can be formed of a plurality of interconnected components, instead of from one sheet of material. The member 104 can be formed of a single ply or multi-ply material. Also, at least a portion, if not all, of the exterior surface of the member 106 can be light-reflecting to enhance visibility of the wearer by others under limited light conditions. In the presently preferred embodiment of the invention, the hook members, snag surfaces, buckles, and belts are stitched to the side members 102 and 106. Stapling, glueing, and other suitable fastening techniques could also be used.

The present invention has been described in detail with particular reference to preferred embodiments thereof, but it will be understood that variations and modifications can be effected within the spirit and scope of the invention.

What is claimed is:

1. A foldable pack belt for carrying at least one article comprising:

a substantially planar member having first and second longitudinally-extending edges interconnected by first and second transversely-extending edges;

first complementary fastening means having a first component associated with said first longitudinally-extending edge and a second component associated with said second longitudinally-extending edge, said first component having a portion thereof selectively releasably engaged by said second component to releasably and adjustably interconnect said first and said second longitudinally-extending edges to each other so that the size of a carrying portion of the pack belt is adjusted whereby a first compressive force is exerted on an article to be carried when longitudinally-extending edges of said planar member are folded about a longitudinally-extending axis and interconnected to each other to encompass the article; and second complementary fastening means having a first component associated with said first transversely-extending edge and a second component associated with said second transversely-extending edge, said first component of said second complementary fastening means having a portion thereof selectively releasably engaged by said second component to adjustably releasably interconnect said first and said second transversely-extending edges to each other so that a second compressive force is exerted on a carried article when said planar member is folded about an axis extending generally perpendicular to the longitudinal axis, the axis being inside and spaced from the folded member, the width of the carrying portion of said planar member being selectively adjustable so that the size of the carrying portion is variable in accordance with the bulk of the carried article.

2. A foldable pack belt according to claim 1, wherein said first complementary fastening means comprises a snag and hook fastener.

3. A foldable pack belt according to claim 1 or 2, wherein said second complementary fastening means comprises a snag and hook fastener.

4. A foldable pack belt according to claim 1, wherein said planar member has an inner surface and an outer surface, and wherein said first complementary fastening means comprises:

a first component comprising a lontidudinally-extending snag surface connected to the outer surface of said planar member generally parallel to and closely spaced from said first longitudinally-extending edge, and a second component comprising a plurality of hook surfaces connected to the inner surface of said planar member, said hook surfaces extending from said second longitudinally-extending edge towards said first longitudinally-extending dge, said hook surfaces being engagable with said snag surface after said first longitudinally-extending edge has been folded about the longitudinal axis.

5. A foldable pack belt according to claim 4, wherein said first component comprises a plurality of longitudinally-extending snag surfaces connected to the outer surface of said planar member generally parallel to and spaced from each other and said first longitudinally-extending edge, said hook surfaces being engagable with at least one of said surfaces.

6. A foldable pack belt according to claim 5, wherein said second complementary fastening means comprises:

a first component comprising a longitudinally-extending snag surface positioned on the outer surface of said planar member and extending from said first towards said second transverse edge in a direction generally parallel to the longitudinal axis, and a second component comprising a hook surface closely spaced from and extending parallel to the second transverse edge and positioned on the inner surface of said planar member, said hook surface being releasably engageable with said snag surface to interconnect said first and said second transverse edges so that the folded member encompasses the waist of a user of the pack belt.

7. A foldable pack belt according to claim 6, wherein said first component of said second complementary fastening means comprises a plurality of snag surfaces, and wherein said second component of said second complementary fastening means comprises a plurality of hook surfaces.

8. A foldable pack belt according to claim 1, wherein said planar member has an inner surface and an outer surface, and wherein said first complementary fastening means comprises:

a first component comprising a longitudinally-extending snag surface connected to the outer surface of said planar member generally parallel to and closely spaced from said second longitudinally-extending edge, and a second component comprising a plurality of hook surfaces connected to the inner surface of said planar member, said hook surfaces extending from said first longitudinally-extending edge towards said second longitudinally-extending edge, said hook surfaces being engagable with said snag surface after said first longitudinally-extending edge has been folded about the longitudinal axis.

9. A foldable pack belt for carrying at least one article comprising:

a planar member having a selectively variable width and an inner surface that encompasses at least one article being carried, an outer surface that is foldable about the body of a user of the pack belt, first and second longitudinally-extending edges, and first and second transversely-extending edges interconnecting the longitudinally-extending edges;

first complementary fastening means for releasably interconnecting portions of the planar member to each other to subject an article positioned on the inner surface of a carrying portion of the belt to a first adjustable compressive force, said first complementary fastening means including:

at least one longitudinally-extending snag surface positioned on the outer surface of said planar member closely spaced from and extending generally parallel to the first longitudinally-extending edge; and a plurality of transversely-extending hook surfaces positioned on the inner surface of said planar member and having first ends located closer to said second than said first longitudinally-extending edge, the other ends of said hook surfaces being spaced further from said longitudinally-extending edge than said first ends, portions of said hook surfaces being releasably engagable with selected portions of said snag surface after said first longitudinally-extending edge has been folded towards said second longitudinally-extending edge, and said second longitudinally-extending edge has been folded over said first longitudinally-extending edge; and second complementary fastening means for releasably interconnecting portions of the planar member to each other to subject an article positioned on the inner surface to a second compressive force, said second complementary means including:

at least one longitudinally-extending snag surface positioned on the exterior surface of said planar member and extending from said first towards said second transversely-extending edge and having an end closely spaced from said first transversely-extending edge, and at least one hook surface positioned on the exterior surface of said planar member adjacent to said second transversely-extending edge, said hook surface being engagable with a selected portion of said snag surface of said second complementary fastening means to exert the second compressive force on the article when the pack belt is releasably secured about the waist of a user, the distance between the carrying portion of said planar member and the longitudinally-extending edges being selectively adjustable so that the volume encompassed by the folding of said longitudinally-extending edges is variable in accordance with the bulk of the carried article, the region of engagement of said snag surface with said hook surfaces of said first complementary fastening means being adjustable and a function of the distance between the longitudinally-extending edges and the carrying portion and the bulk of the at least one articlecarried so that the first adjustable compressive force is exerted on the carried article.

10. A foldable pack belt according to claim 9, wherein said first complementary fastening means comprises a plurality of spaced apart longitudinally-extending snag surfaces.

11. A foldable pack belt according to claim 9 or 10, wherein said second complementary fastening means comprises a plurality of hook and snag surfaces.

12. A foldable pack belt according to claim 11, wherein said hook surface of said second complementary fastening means protrude from said second transversely-extending edge.

13. A foldable pack belt according to claim 12, wherein one of said plurality of hook surfaces of said second complementary fastening means protrudes further from said edge than another of said surfaces so that portions of said surfaces are spaced from each other when said second longitudinally-extending edge is folded over said first longitudinally-extending edge.

14. A foldable pack belt for carrying at least one article comprising:

a planar member having a selectively variable width and an inner surface that encompasses at least one article being carried, an outer surface that is foldable about the body of a user of the pack belt, first and second longitudinally-extending edges, and first and second transversely-extending edges interconnecting the longitudinally-extending edges;

first complementary fastening means for releasably interconnecting portions of the planar member to each other to subject an article positiioned on the inner surface of a carrying portion of the belt to a first adjustable compressive force, said first complementary fastening means including:

at least one longitudinally-extending snag surface positioned on the outer surface of said planar member closely spaced from and extending generally parallel to the second longitudinally-extending edge; and a plurality of transversely-extending hook surfaces positioned on the inner surface of said planar member and having first ends located closer to said first than said second longitudinally-extending edge, the other ends of said hook surfaces being spaced further from said first longitudinally-extending edge than said first ends, portions of said hook surfaces being releasably engagable with selected portions of said snag surface after said first longitudinally-extending edge has been folded towards said second longitudinally-extending edge, and said second longitudinally-extending edge has been folded over said first longitudinally-extending edge; and second complementary fastening means for releasably interconnecting portions of the planar member to each other to subject an article positioned on the inner surface to a second compressive force, said second complementary means including:

at least one longitudinally-extending snag surface positioned on the exterior surface of said planar member and extending from said first towards said second transversely-extending edge and having an end closely spaced from said first transversely-extending edge, and at least one hook surface positioned on the exterior surface of said planar member adjacent to said second transversely-extending edge, said hook surface being engagable with a selected portion of said snag surface of said second complementary fastening means to exert the second compressive force on the article when the pack belt is releasably secured about the waist of a user, the distance between the carrying portion of said planar member and the longitudinally-extending edges being selectively adjustable so that the volume encompassed by the folding of said longitudinally-extending edges is variable in accordance with the bulk of the carried article, the region of engagement of said snag surface with said hook surfaces of said first complementary fastening means being adjustable and a function of the distance between the longitudinally-extending edges and the carrying portion and the bulk of the at least one article carried so that the first adjustable compressive force is exerted on the carried article.

15. A foldable pack belt according to claim 1 or 9 wherein said planar member comprises:

first and second elongate side members, each of said side members having a central portion positioned between end portions, the central and end portions having aligned outer longitudinal side edges, the entra portion having a body portion and an enlarged rectangular portion protruding therefrom beyond inner longitudinal side edges of the end portions;

a central member positioned between the side members and having longitudinal side edge portions secured to confronting inner longitudinal side edges of the end portions and the longitudinal edge of the enlarged rectangular portion, the material of the enlarged rectangular portions being foldable on to the body portions to vary the distance between the outer longitudinal side edges and the central member; and cooperating fastening means having a first component associated with the longituinal edge of each of the enlarged rectangular portions and a second component associated with the body portion of each of the central portions, the components of the cooperating fastening means being engageable with each other to maintain the enlarged rectangular portions in folded conditions.

16. A foldable pack belt according to claim 15, wherein one of the componens of the coperating fastening means is a buckle and the other of the components is a belt, the belt having a portion thereof selectively releasably engaged by said buckle to maintain the enlarged rectangular portion in a folded condition which determines the distance between the outer longitudinal side edges and the central member of the pack belt.

* * * * *